US005160206A

United States Patent [19]

Haftmann et al.

[11] Patent Number: 5,160,206

[45] Date of Patent: Nov. 3, 1992

[54] HOLDER OF A RIBBON WITH SUPPLY AND TAKE-UP SPOOLS FOR TYPEWRITERS OR SIMILAR MACHINES

[75] Inventors: Johannes Haftmann, Schwabach; Werner Haczek, Furth, both of Fed. Rep. of Germany

[73] Assignee: Ta Triumph-Adler Aktiengesellschaft, Nuremberg, Fed. Rep. of Germany

[21] Appl. No.: 559,539

[22] Filed: Jul. 23, 1990

Related U.S. Application Data

[63] Continuation of Ser. No. 280,484, Dec. 6, 1988, abandoned.

[30] Foreign Application Priority Data

Dec. 7, 1987 [DE] Fed. Rep. of Germany ..... 3741362

[51] Int. Cl.[5] ..... B41J 35/28

[52] U.S. Cl. ..... 400/250; 400/208

[58] Field of Search ..... 400/194, 195, 196, 196.1, 400/207, 208, 208.1, 250, 248, 248.1, 693.1

[56] References Cited

U.S. PATENT DOCUMENTS

| | | | |
|---|---|---|---|
| 3,977,511 | 8/1976 | Hengelhaupt | 400/248 |
| 4,003,460 | 1/1977 | Gray et al. | 400/208 |
| 4,352,575 | 10/1982 | Shore | 400/250 |
| 4,955,737 | 9/1990 | Haftmann et al. | 400/208 |
| 4,964,743 | 10/1990 | Haftmann et al. | 400/208.1 |
| 4,990,006 | 2/1991 | Haftmann et al. | 400/208 |

FOREIGN PATENT DOCUMENTS

| | | | |
|---|---|---|---|
| 42031 | 12/1981 | European Pat. Off. | 400/208 |
| 2405099 | 12/1980 | Fed. Rep. of Germany . | |
| 8310441 | 7/1984 | Fed. Rep. of Germany . | |
| 66680 | 4/1986 | Japan | 400/208 |
| 195874 | 8/1986 | Japan | 400/208 |
| 211075 | 9/1986 | Japan | 400/208 |

*Primary Examiner*—David A. Wiecking
*Attorney, Agent, or Firm*—Browdy and Neimark

[57] ABSTRACT

A holder of a ribbon with supply and take-up spools for typewriters and similar machines where the holder is insertable into a receptacle of the machine and has guide elements for the ribbon. The retention elements for the ribbon are designed so that the ribbon slides out of them when the side elements of the receptacle are pivoted back into their operational position. This assures on the one hand, that the ribbon is secured in a position during movement in the course of shipment which easily makes possible the insertion of the holder into the receptacle. On the other hand it is also assured that the ribbon is pushed out of these guidance elements during insertion of the holder into the receptacle and in this way attains its functionally correct position in the typewriter.

5 Claims, 1 Drawing Sheet

HOLDER OF A RIBBON WITH SUPPLY AND TAKE-UP SPOOLS FOR TYPEWRITERS OR SIMILAR MACHINES

This application is a continuation of application Ser. No. 07/280,484 filed Dec. 6, 1988, now abandoned.

FIELD OF THE INVENTION

The invention relates to a holder of a ribbon with supply and take-up spools for typewriters and similar machines where the holder is insertable into a receptacle of the machine and has guide elements for the ribbon.

BACKGROUND OF THE INVENTION

It is known from German Patent DE-PS 24 05 099 to provide a holder which makes the insertion of the ribbon with its spools into a receptacle of the machine easier. Manipulation of this holder requires a certain skill which first must be acquired by the operator. Furthermore, the holder consists of several parts which must be installed and thus is not cheap to manufacture. Added to this is that the ribbon, after the spools have been inserted into the receptacle, is not under tension but is comparatively slack.

SUMMARY OF THE INVENTION

It is an object of the invention to design a holder according to the species so that the ribbon is held by the holder in such a way that it can be inserted easily and without requiring any skill into the receptacle of the machine. At the same time it is also to be provided that the ribbon has the tension required for correct operation. One embodiment of the holder of the present invention includes retention elements for the ribbon disposed in the area of the front ribbon guidance elements. The retention elements are designed so that when forces act on the ribbon, the latter no longer is retained by the retention elements. In this way insertion of the ribbon into the receptacle is made easier so that no particular skill need be used. Furthermore it is provided that the ribbon attains the tension required and necessary for its operation. A number of different possibilities for applying the force for tensioning the ribbon are provided. The force acting on the ribbon may be exerted by a ribbon tensioning element of the receptacle. Alternatively, the force acting on the ribbon may be exerted by fingers provided on a pivotable side element of the receptacle. Alternatively, the force acting on the ribbon may be provided by turning a small ribbon tensioning wheel. A preferred embodiment of the retention elements for the ribbon in the holder are provided in that the retention elements for the ribbon are hooks facing each other, the points of which are at a distance from each other.

Still other objects, features and attendant advantages of the present invention will become apparent to those skilled in the art from a reading of the following detailed description of the embodiments constructed in accordance therewith, taken in conjunction with the accompanying drawings.

BRIEF DESCRIPTION OF THE DRAWING

The invention of the present application will now be described in more detail with reference to the preferred embodiments of the device, given only by way of example, and with reference to the accompanying drawings, in which.

DETAILED DESCRIPTION OF A PREFERRED EMBODIMENT

Figure 1B:
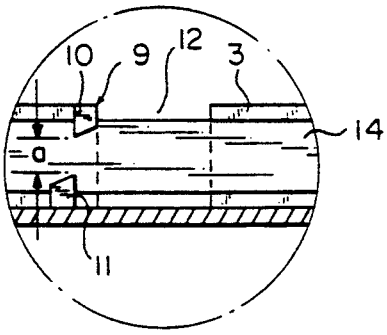
FIG. 1B shows the retention elements are shown particularly clearly in a detailed view.
Figure 1A:
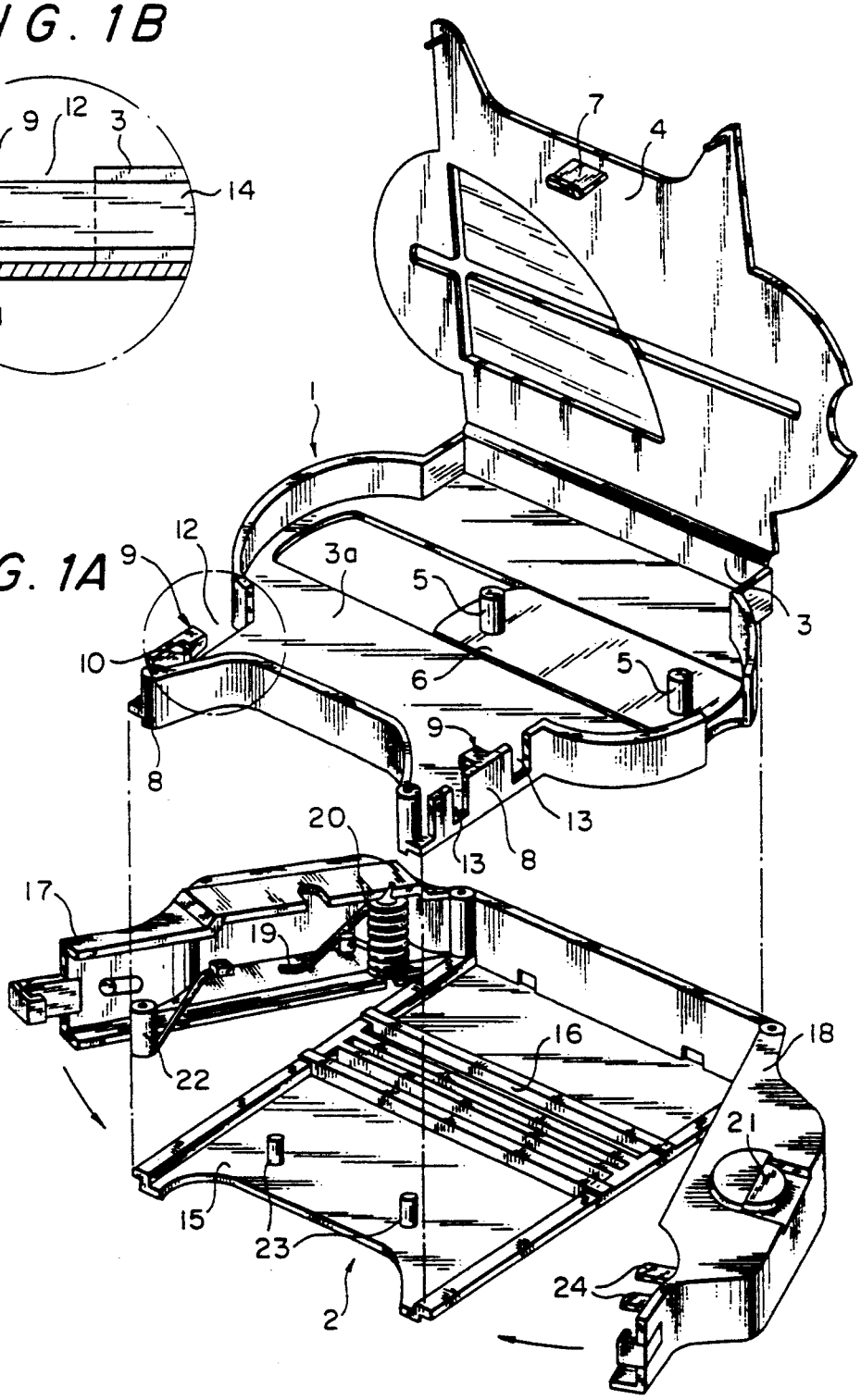
FIG. 1A is a perspective view of a holder for the ribbon in opened position, but without ribbon spools, as well as the receptacle for this holder.

In the drawings the holder for the ribbon is designated by the reference numeral 1 and the receptacle with 2. The holder 1 is in the form of a cassette and is made of a one-piece molded plastic element molded such that a base plate 3*a* with a surrounding wall 3 and a cover 4 hinged thereon result. After insertion of the ribbon spools over the receiving shafts 5 of a slider 6, the cover 4 can be closed. To maintain the cover 4 in the closed position, hook-shaped closing elements 7, for example, may be provided which engage a hole in the base plate 3*a*. However, this hole is not shown in the drawing.

As customary in ribbon cassettes, the holder 1 is provided with ribbon guidance elements 8, which are in the form of arms and between which the ribbon is guided at the place of printing of the typewriter in a known manner. In the present case retention elements 9 are provided on the side walls of the ribbon guidance elements 8 which are directed inwardly and are described below and which can be seen better in the detailed view shown in FIG. 1B. Two hooks 10 and 11 are disposed on the upper and lower edge of the wall 3 in the area of the ribbon guidance element 8 in such a way that they are slightly offset laterally in respect to each other. The hooks 10 and 11 are also sufficiently long so that they are at a predetermined distance (a) from each other. Next to the hooks 10 and 11, the wall 3 of the holder 1 is provided with an opening 12. At the other ribbon guidance element 8 of the holder 1 the arrangement is such that to the left and the right of the hooks 10 and 11, which together form the retention element 9, there are slits 13 in the wall 3. The ribbon 14 is placed inside the holder 1 in such a way that it rests on the inside of the wall 3 in the area of the ribbon guidance elements 8 between the spools placed on the receiving shaft 5 and the printing place located between the ribbon guidance elements 8 and that it is securely retained by the retention elements 9.

The receptacle 2 comprises a base element 15 on which are disposed guide elements 16 for the slider 6. It should be mentioned here that the operation of the slider in the holder 1 is of the type known from German Utility Model DE-GM 83 10 441. Additionally, pivotable side elements 17 and 18 are hinged on the receptacle 2 which, when in their operational position, surround the outside of the holder 1 in the form of a shell. Additional operational elements are disposed on the pivotable side elements 17 and 18. They are, in accordance with the embodiment shown, the spring arm 19 of a torsion spring 20, the spring arm 19 supplying the force required to press the slider 6 against the sprocket wheel, not shown in the drawing, on the side element 17 which is of one part with the small ribbon tensioning wheel 21. Furthermore, a flexible ribbon tensioning element 22 is disposed on the pivotable side element 17. The other side element 18 has two fingers 24, the distance of which is as large as the slits 13 in the wall 3 of the holder 1.

The holder 1 is placed from above on the base plate 15 of the receptacle 2. In order to do this positionally correctly, two pins 23 are disposed on the base plate 15 which correspond with respective holes (not shown) in the base 3*a* of the holder 1. The pivotable side elements 17 and 18 must be pivoted against the base element 15 of the receptacle 2. The side elements 17 and 18 cover the holder 1 from both lateral directions in the form of a shell. Now the tensioning element 22 takes effect by abutting through the opening 12 on the ribbon 14, thereby pushing it out of the hook-shaped retention elements 9 and the ribbon guidance element 8. The finger 24 of the pivotable side element 18 extends into the slits 13 of the holder 1 and also pushes the ribbon 14 out of the retention element 9 at that place. Now the entire device, comprising the receptacle 2 and the holder 1, can be inserted into the typewriter or the printer. The machine is then ready for operation without the necessity of further manipulation of the ribbon. The tensioning element 22 also sees to it that the ribbon always maintains the required tension during operation of the typewriter.

In another embodiment the force required to pull the ribbon out of the retention elements 9 may be supplied by the small ribbon tensioning wheel 21 by turning this small wheel. As already mentioned, this small wheel is of one piece with the sprocket wheel against which the take-up spool (not shown), located on the slider 6, is pressed. If this small wheel is turned, the take-up spool also turns in the direction of take-up so that a pull is exercised on the ribbon 14 which, since the ribbon 14 (as is presumed in this embodiment) does not run along the direct, i.e. shortest, distance between the guidance element (not shown) respectively located ahead of and behind the retention element 9, is sufficient to pull the ribbon 14 out of the retention elements 9. The latter need not have the hook-like design described and shown, other designs are also conceivable here.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A holder housing for a ribbon with supply and take-up spools for typewriters or similar machines, a ribbon and a receptacle: which holder housing has at least one flat plate with encompassing side walls disposed on it; which holder housing has guides for the ribbon and receiving shafts, disposed on a slide, for supporting ribbon supply and take-up spools; and which holder housing is placed into said receptacle (2) that comprises a bottom plate (15) and swivelable side elements disposed laterally on said plate that can be swivelled out of the way, which swivelable side elements (17, 18) encompass the outer ends of the holder housing of the ribbon in clamshell-like form in the operating position wherein retention means elements (9) for engaging the ribbon (14) are disposed on the encompassing walls (3) in the region between ribbon guidance elements (8) and the ribbon spools supported on the receiving shafts (5), means on the receptacle (2) for exerting a force on and moving the ribbon out of engagement with the retention means elements (9);

and wherein a ribbon tensioning element (22) for exerting a force on and moving said ribbon, is disposed on one of the swivelable side elements (17), and when the holder housing (1) is placed into the receptacle (2) and when the one of the swivelable side elements (17) is swivelled into position, the ribbon tensioning element reaches through an opening (12) in the wall (3) of the holder (1) directly beside one of the retention means elements (9) and disengages the ribbon from said one of the retention elements.

2. The holder housing of claim 1, characterized in that a force acting upon the ribbon (14) is additionally exerted by fingers (24), which are disposed on another one of the swivelable side elements (18) of the receptacle (2), such that when the holder housing (1) is placed into the receptacle (2) and the another one of the swivelable side elements (18) is swivelled into position, the fingers (24) reach through slits (13) in the encompassing side walls (3) of the holder housing (1) directly beside another one of the retention means elements (9) and disengages the ribbon from said another one of the retention elements (9).

3. A holder housing for a ribbon with supply and take-up spools for typewriters or similar machines, a ribbon and a receptacle: which holder housing has at least one flat plate with encompassing side walls disposed on it; which holder housing has guides for the ribbon and receiving shafts, disposed on a slide, for supporting ribbon supply and take-up spools; and which holder housing is placed into said receptacle (2) that comprises a bottom plate (15) and swivelable side elements disposed laterally on said plate that can be swivelled out of the way, which swivelable side elements (17, 18) encompass the outer ends of the holder housing of the ribbon in clamshell-like form in the operating position wherein retention means elements (9) for engaging the ribbon (14) are disposed on the encompassing walls (3) in the region between ribbon guidance elements (8) and the ribbon spools supported on the receiving shafts (5), means on the receptacle (2) for exerting a force on and moving the ribbon out of engagement with the retention means elements (9);

wherein a force exerted upon the ribbon (14), by a ribbon tensioning element (22) when in its operative position, is brought to bear by the rotation of a ribbon tensioning wheel (21) in its operative position, whereupon as a result of increasing ribbon tension the ribbon (14) is pulled out of the retention means elements (9).

4. A holder housing for a ribbon with supply and take-up spools for typewriters or similar machines, a ribbon and a receptacle: which holder housing has at least one flat plate with encompassing side walls disposed on it; which holder housing has guides for the ribbon and receiving shafts, disposed on a slide, for supporting ribbon supply and take-up spools; and which holder housing is placed into the receptacle (2) that comprises a bottom plate (15) and swivelable side elements disposed laterally on said plate that can be swivelled out of the way, which swivelable side elements (17, 18) encompass the outer ends of the holder housing of the ribbon in clamshell-like form in the operating position wherein retention means elements (9) for engaging the ribbon 914) are disposed on the encompassing walls (3) in the region between ribbon guidance elements (8) and the ribbon spools supported on the receiving shafts (5), means on the receptacle (2) for exerting a force on and moving the ribbon out of engagement with the retention means elements (9);

wherein the retention means elements (9) for the ribbon (14) are hooks (10, 11) oriented toward one another, the points of which are spaced apart by a distance (a), the ribbon (14) being put into place between the wall (3) and the hooks (10, 11).

5. A holder housing for a ribbon with supply and take-up spools for typewriters or similar machines and a ribbon: which holder housing has at least one flat plate with encompassing side walls disposed on it; which ribbon housing has guides for a ribbon and receiving shafts, disposed on a slide, for supporting ribbon supply and take-up spools; and a receptacle (2) that comprises a bottom plate (15) and swivelable side elements disposed laterally on said plate that can be swivelled out of the way, which swivelable side elements (17, 18) encompass the outer ends of the holder housing of the ribbon in clamshell-like form in the operating position:

wherein retention means elements (9) for the ribbon (14) are located in the holder housing to engage the ribbon and are disposed on said encompassing side walls (3) in the region between ribbon guidance elements (8) and ribbon spools supported on receiving shafts (5), the retention means elements (9) being embodied such that forces acting upon the ribbon (14) move the ribbon out of engagement with the retention means elements (9).

* * * * *